US006006366A

United States Patent [19]

Vondrak

[11] Patent Number: 6,006,366

[45] Date of Patent: Dec. 28, 1999

[54] POLARIZED LENS FOR HELMET FACE SHIELD

[76] Inventor: Paul C. Vondrak, Okauchee, Wis.

[21] Appl. No.: 08/948,285

[22] Filed: Oct. 10, 1997

[51] Int. Cl.[6] ..... A42B 3/22

[52] U.S. Cl. ..... 2/424; 2/10

[58] Field of Search ..... 2/410, 411, 424, 2/425, 8, 9, 10, 15, 432, 454, 434, 441, 443; 206/5; 351/44, 47, 49

[56] References Cited

U.S. PATENT DOCUMENTS

| | | | |
|---|---|---|---|
| 2,759,394 | 8/1956 | Evans | 2/432 |
| 3,254,932 | 6/1966 | Blaney | 351/47 |
| 3,868,727 | 3/1975 | Paschall | 2/8 |
| 4,863,013 | 9/1989 | Eastman | 206/5 |
| 4,899,873 | 2/1990 | Bolle et al. | 206/5 |
| 5,131,101 | 7/1992 | Chin | 2/424 |
| 5,647,066 | 7/1997 | Joslin et al. | 2/424 |
| 5,671,483 | 9/1997 | Reuber | 2/424 |
| 5,851,328 | 12/1998 | Kohan | 156/102 |

FOREIGN PATENT DOCUMENTS

| | | | |
|---|---|---|---|
| 3517411 | 11/1986 | Germany | 2/424 |
| 2052244 | 1/1981 | United Kingdom | 2/424 |

OTHER PUBLICATIONS

International Polarizer, Inc. brochure, Aug. 14, 1997 (admitted prior art).

*Primary Examiner*—Michael A. Neas

[57] ABSTRACT

A polarized lens is mounted to a helmet having a transparent face shield to cover a top portion of the face shield and reduce glare in the user's field of vision. In the preferred embodiment of the invention, the polarized lens does not cover the lower portion of the transparent face shield so that the user's primary field of vision can be adjusted to pass through the uncovered lower portion of the transparent face shield when the user tilts their head back slightly. The lens is preferably attached to the helmet using hook and loop fastener. On a sunny day, a helmet wearer, e.g. a snowmobiler or a motorcycle rider, can attach the polarized lens to reduce glare, and can tilt their head back slightly if the sunlight disappears temporarily (e.g. when the vehicle passes into the woods). In addition, the user can easily remove the polarized lens if the sunlight disappears for an extended time.

14 Claims, 4 Drawing Sheets

POLARIZED LENS FOR HELMET FACE SHIELD

FIELD OF THE INVENTION

The invention relates to a polarized lens which covers the transparent face shield on helmets typically worn by snowmobilers or motorcycle riders.

BACKGROUND OF THE INVENTION

Helmets worn by snowmobilers typically include a transparent face shield. This is also often true for motorcycle helmets. The transparent face shield is normally hinge-mounted to the helmet so that the face shield can rotate between a position in front of the user's face to a position above the user's face. Under normal operating conditions, the helmet wearer places the face shield in a closed position to protect the face from wind and/or debris. Usually, the hinge includes a ratchet mechanism to lock the face shield at various degrees of rotation and prevent rotation of the face shield unless the user uses their hand to move the face shield.

Face shields in snowmobile and motorcycle helmets are either clear or tinted. Many snowmobilers and motorcycle riders prefer clear face shields because a tinted face shield is not desirable when it is dark or otherwise not sunny outside. A common occurrence, especially among snowmobilers, is to alternate the use of clear and tinted face shields depending on the weather conditions. The replacement of face shields, however, requires tools and is cumbersome. Also, it is often difficult to store an additional face shield on the vehicle. For these reasons, many snowmobilers or motorcycle riders use helmets having clear, non-tinted face shields, and wear sunglasses underneath the helmet when it is sunny outside. Sunglasses worn underneath a snowmobile helmet tend to fog. Also, the added pressure against the head from the helmet pushing on the ear piece of the sunglasses can cause headaches in some of people.

In addition, it is difficult for a driver to see through a tinted face shield when the vehicle passes from a sunlit area temporarily into a shaded area. This is a common occurrence when snowmobiling because in as much as many snowmobile trails frequently pass into and out of wooded areas. Likewise, when a snowmobiler wearing sunglasses under the helmet drives into a shaded area, such as into the woods, it is difficult to see through the sunglasses due to the relative darkness.

SUMMARY OF THE INVENTION

In one aspect, the invention is a polarized lens shaped to cover a top portion of a transparent face shield of a helmet. The polarized lens does not cover the lower portion of the transparent face shield. The polarized lens thus reduces glare in the user's field of vision when the user is holding their head comfortably in a normal upright position. However, the invention allow users to easily account for temporary shade, for instance when a snowmobiler enters a shaded area such as the woods or the like, by cocking their head slightly backward so that the user's primary field of vision passes under the polarized lens through the uncovered lower portion of the transparent face shield. Preferably, the bottom edge of the polarized lens is located 1 ⅛ inches above the bottom edge of the transparent face shield, thus providing a 1 ⅛ inch span underneath the polarized lens 10 to accommodate the user's field of vision when the user encounters shade.

It is important that the polarization axis of the polarized lens be generally horizontal when the polarized lens is mounted to the helmet, as is conventional with polarized sunglasses. This is because reflected light, such as light reflected from snow-covered ground, is normally polarized in such a manner that a horizontal polarization axis optimizes glare reduction. It is preferred that the lens span entirely across the transparent face shield from its right side to its left side in order to account for peripheral glare.

In the preferred embodiment of the invention, the polarized lens is removably mounted to the helmet adjacent an outside surface of the transparent face shield. It is preferred to use strips of hook and loop fastener along the top and side edges of the lens and the transparent face shield. Preferably, the hook component of the hook and loop fastener is applied to the face shield on the helmet. This is preferred because the fastener strips remain on the helmet even when the polarized lens is removed, and the hook component is more durable than the loop component under these conditions.

In this embodiment of the invention in which the polarized lens is removable from the helmet, the invention can be easily applied to existing helmets. Thus, it is desirable to provide a kit for distribution which includes the polarized lens with the respective strips of hook and loop fastener pre-attached to the lens (i.e. the loop component of the hook and loop fastener strips attached to the lens), loose mating strips of hook and loop fastener intended to be applied to the helmet (i.e. the hook component of the hook and loop fastener strips), with the backing remaining on the adhesive side of the mating strips. The polarized lens in the kit should be custom-shaped for the particular helmet model for which it is intended. Preferably, the loose mating strips of hook and loop fastener are pre-cut in proper lengths for the particular model of helmet. It may also be desirable to provide a bag for the polarized lens with the kit, for protecting the lens when it is not in use. Such a bag preferably has an absorbent, scratch-resistant interior surface. Also, the bag preferably has an absorbent, scratch-resistant exterior surface to facilitate cleaning of the lens.

In another embodiment of the invention, the polarized lens is permanently attached to the transparent face shield, preferably directly to the inside surface of the transparent face shield. This should be accomplished using optical quality adhesive to adhere the entire surface of the lens to the face shield to avoid fogging, moisture accumulation and the like between the lens and the transparent face shield.

In another aspect of the invention, the polarized lens completely covers the transparent face shield, yet is removable. The removable, full-face polarized lens is mounted to the helmet adjacent an outside surface of the transparent face shield, preferably using strips of hook and loop fastener around the edges of the transparent face shield and the polarized lens. While such a system does not provide the gradient effect of the polarized lens over the transparent face shield, the removability of the full-face, polarized lens is a significant improvement over wearing sunglasses underneath the helmet and/or changing mechanically between clear and tinted face shields.

Other features and advantages of the invention should become apparent to those skilled in the art upon inspecting the following drawings and description thereof.

DETAILED DESCRIPTION OF THE DRAWINGS

Figure 6:
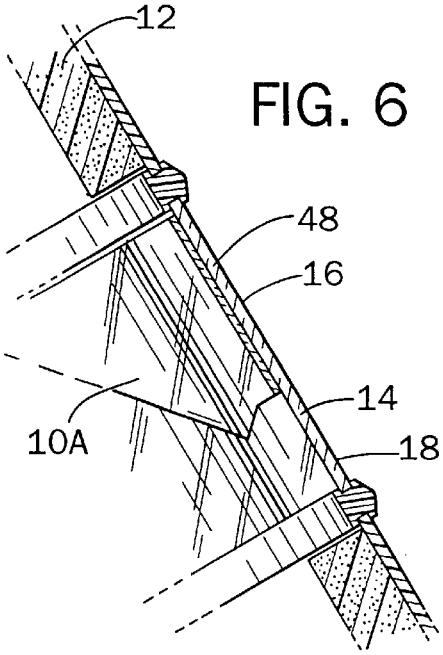
FIG. 6 is a sectional view similar to FIG. 4 showing another embodiment of the invention in which the polarized lens is adhered directly to an inside surface of the transparent face shield for the helmet.

FIGS. 1–5 refer to a first embodiment of the invention in which a polarized lens 10 is removably mounted to a helmet 12 to partially cover a transparent face shield 14 for the helmet 12. FIG. 6 refers to an embodiment of the invention in which the polarized lens 10 is adhered permanently to an inside surface of the transparent face shield 14 to partially cover the transparent face shield.

Figure 1:
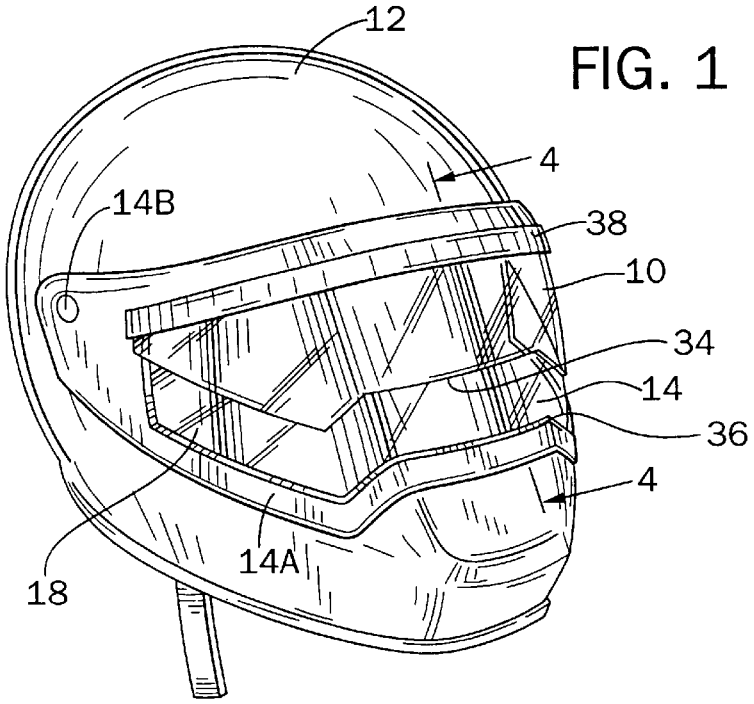
FIG. 1 is a perspective view of a snowmobile helmet having a transparent face shield with a polarized lens mounted to the helmet to cover a portion of the transparent face shield in accordance with one aspect of the invention.
Figure 2:
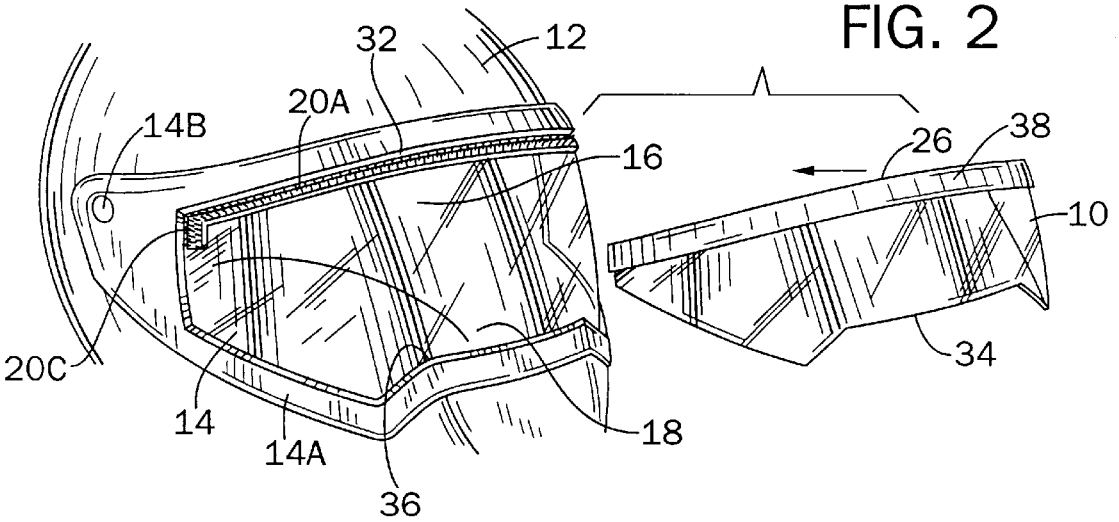
FIG. 2 is a view similar to FIG. 1 showing the polarized lens removed from the transparent face shield of the helmet.

Referring in particular to FIGS. 1 and 2, the polarized lens 10 is removably attached to the helmet 12 to cover a top portion 16 of the transparent face shield 14. The polarized lens 10 reduces glare in the user's field of vision when the user is holding their head comfortably in a normal upright position. In FIGS. 1 and 2, the polarized lens 10 does not cover a lower portion 18 of the transparent face shield 14. This allows the user's primary field of vision to pass through the uncovered lower portion 18 of the transparent face shield 14 when the user tilts their head slightly back.

The polarized lens 10 is preferably manufactured from a sheet of laminated linear polarizer, such as is commercially available from International Polarizer, Inc., Marlborough, Mass. The preferred laminated linear polarizer comprises a polymeric polarizer laminated with cellulose acetobutyrate. For the embodiment of the invention shown in FIGS. 1–5 where the polarized lens 10 is removably attached outside of the helmet 12, it is desirable to use a laminated linear polarizer having a thickness of about 0.03 inches to provide sufficient strength and durability to withstand wind, etc. The shape of the polarized lens 10 is preferably formed using a steel form die-cut. In most instances, it will be desirable to customize the shape of the polarized lens 10 for the particular shape of the transparent face shield 14 of the particular helmet for which it is designed. The sheets of laminated linear polarizer normally include a protective covering over both the inside surface and the outside surface, and it is preferred to leave the removable protective coating on the sheets during fabrication. As is conventional with polarized sunglasses, the polarization axis of the polarized lens 10 is preferably horizontal when the lens 10 is attached to the helmet 12. Glare consists of polarized light reflected from the surface, e.g. from snow-covered surfaces for snowmobile riders, and the polarized lens 10 absorbs most if not all of the glare yet allows desired light to pass through.

The polarized lens 10 is preferably mounted directly to the transparent face shield 14 of the helmet 12 using strips 20A, 20B, 20C and 22A, 22B and 22C of hook and loop fastener, commonly known as Velcro. The loop component 22A, 22B and 22C of the hook and loop fastener strips is applied to an inside surface 24 of the removable lens 10, see FIG. 3. The strips 22A, 22B, 22C are preferably ¼ inch wide. Strip 22A is applied to the inside surface 24 of the lens 10 along a top edge 26 of the lens 10. Strip 22B is applied to the inside surface 24 of the lens 10 along a left side edge 28 of the lens 10. Strip 22C is applied to the inside surface 24 of the lens 10 along a right side edge 30 of the lens 10. In general, the strips 22A, 22B and 22C are applied to the inside surface 24 of the lens 10 and are located out of the normal field of vision of a user wearing the helmet 12. Mating strips 20A, 20B, 20C of the hook component of hook and loop fasteners are applied preferably directly on the transparent face shield 14 of the helmet 12, also out o the normal field of vision of a user wearing the helmet 12. Strip 20A is applied to an outside surface of the transparent face shield 14 along a top edge 32 of the face shield 14. Strip 20B is applied to an outside surface of the face shield 14 adjacent a part of a left edge (not specifically shown) of the face shield 14. Strip 20C is applied to an outside surface of the face shield 14 adjacent a top part of the right edge 20C of the transparent face shield 14. The polarized lens 10 is removably attached to the helmet 12 by engaging strips 22A, 22B, 22C on the lens 10 with the strips 20A, 20B and 20C on the helmet 12. FIG. 4 shows a cross-section of the removable polarized lens 10 being attached to the transparent face shield 14 of the helmet 12 in this manner. Note that FIG. 4 shows a helmet 12 having a transparent face shield 14 that is permanently closed, whereas the helmet 12 shown in FIGS. 1 and 2 has the transparent face shield 14 attached to a movable frame 14A which can be rotated about pivot 14B to open and close the face shield 14. As can be seen in FIG. 4, a small space will typically exist between the lens 10 and the covered portion 16 of the transparent face shield 14. Since the lens 10 is on the outside of the transparent face shield 14, it is unlikely that fogging will occur in the space. However, depending on the specific mounting configuration of the lens 10 to the helmet 12, it may be possible for snow dust to accumulate in the space between the lens 10 and the face shield 14. Snow dust accumulation can be prevented from collecting within this space by providing a transparent seal (e.g. a snow dust guard) on the bottom edge 34 of the lens 10 which extends inward against the face shield 14. Alternatively, it may be possible to tilt the mounting of the lens 10 on the helmet 12 so that the bottom edge 34 of the removable lens 10 rests close or near the transparent face shield 14 FIG. 4A.

Referring again to FIGS. 1 and 2, the removable polarized lens 10 covers the transparent face shield 14 from the top edge 32 of the face shield 14 downward to a bottom edge 34 of the lens 10. For most helmets, the bottom edge 34 of the lens 10 should be located between 1 ⅝ inch to ⅝ inches above the corresponding location on the bottom edge 36 of the transparent face shield 14 when the polarized lens 10 is mounted to the helmet 12. Preferably, the bottom edge 34 of the lens 10 is located 1 ⅛ inch above the bottom edge 36 of the transparent face shield 14. Testing has determined that this configuration allows optimized glare reduction for most helmet designs, yet allows the helmet user to comfortably redirect their field of vision through the uncovered lower portion 18 of the face shield 14. It is also preferred that the polarized lens 10 span continuously across the face shield 14 between the left side edge and the right side edge 20C of the transparent face shield 14 to account for peripheral glare. In general, it is preferred in this embodiment of the invention that the polarized lens 10 cover approximately ⅔ of the surface area of the transparent face shield 14.

A printable grip strip 38 is preferably adhered to the outside surface of the removable lens 10 entirely along the top edge 26 of the lens 10. The grip strip 38 is preferably made from an ultraviolet protected vinyl adhesive tape. The grip strip 38 provides a location for a user to grab the lens 10 without harming the lens surface. The grip strip 38 also covers the strip 22A of hook and loop fastener on the inside surface of the lens 10 as well as most of strips 22B and 22C, from view in front of the lens 10. A company logo or the like can be printed on the grip strip 38.

Figure 3:
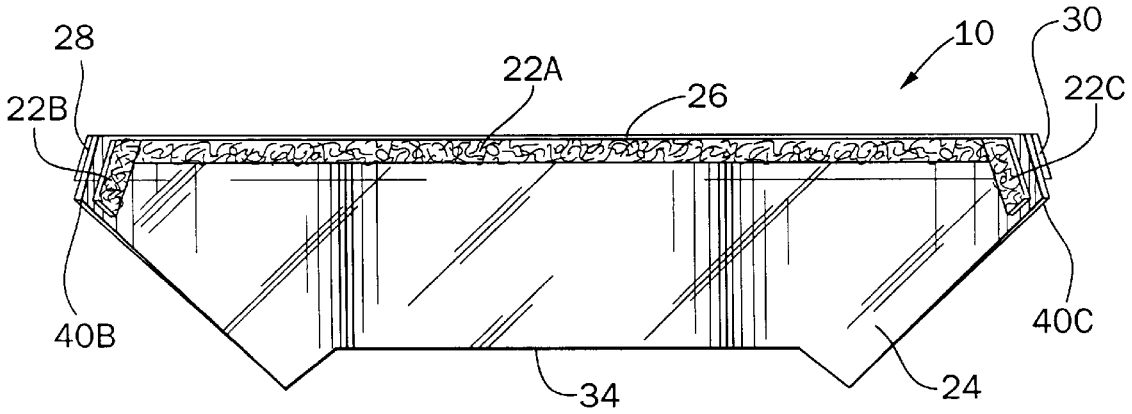
FIG. 3 is a rear elevational view of a removable polarized lens in accordance with the invention.
Figure 4:
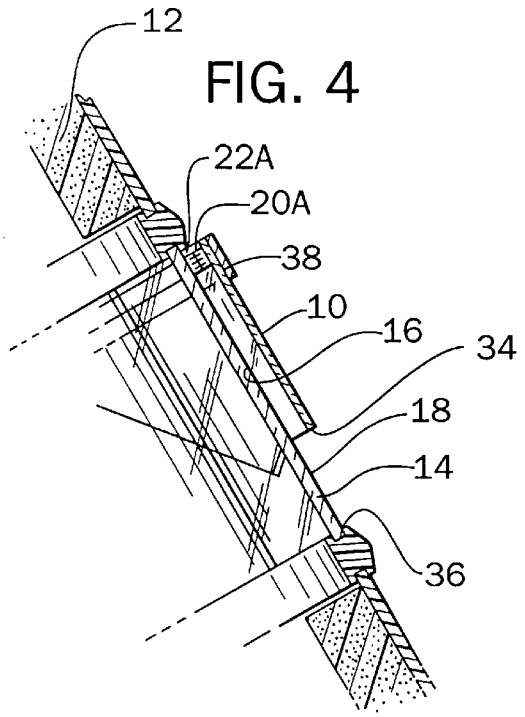
FIG. 4 is a sectional view taken along line 4—4 in FIG. 1.
Figure 4A:
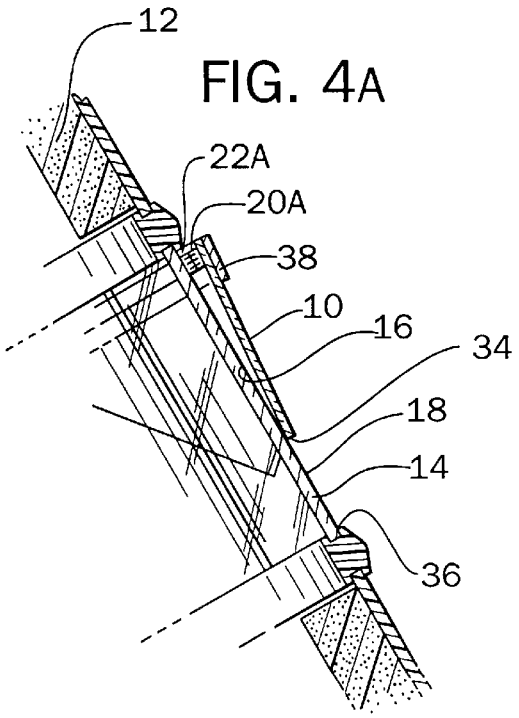
FIG. 4A is a view of similar to FIG. 4 showing an alternate embodiment of mounting the removable polarized lens.
Figure 5:
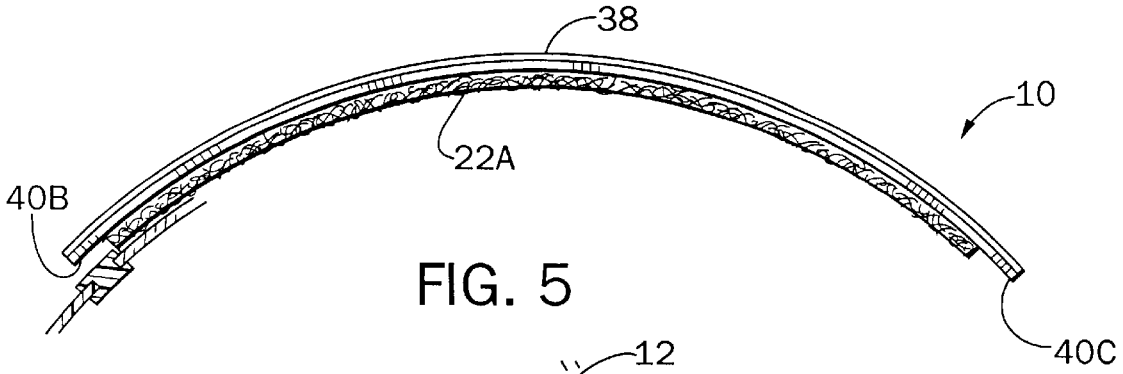
FIG. 5 is a top elevational view of a removable polarized lens shown in partial section to be attached to a transparent face shield on a helmet.

In order to facilitate attachment and removal of the polarized lens 10 from the transparent face shield 14, which may be cumbersome for people wearing gloves, the lens 10 is preferably designed so that portions 40B, 40C, FIG. 3, extend outward beyond the strips 22B and 22C of hook and loop fastener. The portions 40B and 40C thus serve as handle means to facilitate the attachment and removal of the lens 10.

Figure 7:
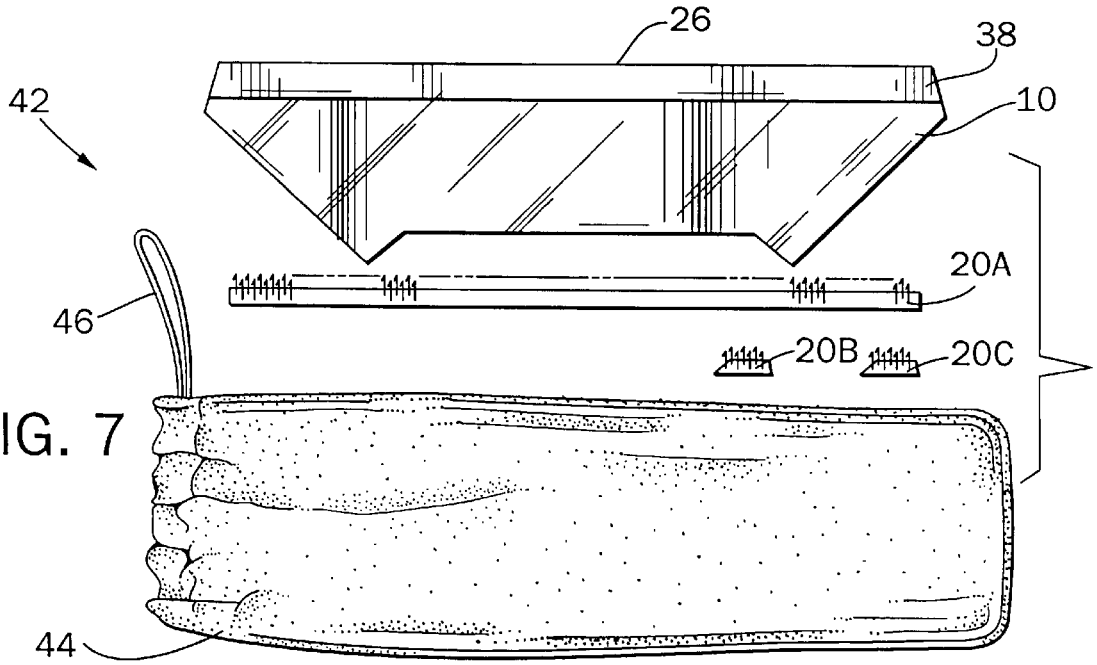
FIG. 7 is a schematic view showing the components of a kit that facilitates distribution of the invention to existing snowmobile helmets, and also store the polarized tinted lens when not in use.

FIG. 7 illustrates the components of a kit 42 that is provided to a helmet owner who desires to implement the invention on a pre-existing helmet. The kit includes a polarized lens 10 as previously described with respect to FIGS. 1–5, precut strips 20A, 20B and 20C of mating hook and loop fastener, and a bag 44 for storing the lens 10 when it is not in use. It is preferred that the strips of hook and loop fastener 22A, 22B, 22C on the lens 10 be pre-attached to the inside surface of the lens 10 when distributing the kit 42. The strips of hook and loop fastener 20A, 20B, 20C should have the adhesive-backed surface covered by a backing strip, and should be sized in correspondence to the strips 22A, 22B, 22C pre-applied to the lens 10. The bag 44 is preferably made of a soft cloth material. The inside surface of the bag should be absorbent and scratch-resistant to protect the lens 10. The outside surface of the bag 44 should be absorbent and scratch-resistant as well to facilitate convenient cleaning of the lens 10 inasmuch as it may be difficult to locate suitable fabric for cleaning the lens while snowmobiling. The bag 44 includes a drawstring 46 to close the bag 44 with the lens 10 therein.

The invention has been described thus far as showing the polarized lens 10 removably attached to the outside surface of the transparent face shield 14 using hook and loop fasteners, however, the inventor has contemplated other means of attaching the lens 10 to the helmet 12. For example, snaps or the like could possibly be used to removably attach the polarized lens 10. In addition, it may be desirable in certain circumstances to permanently attached the polarized lens 10 to the transparent face shield 14.

FIG. 6 illustrates the preferred manner of permanently attaching the polarized lens 10 to the transparent face shield. In FIG. 6, a die-cut sheet 10A of a laminated linear polarizer is permanently adhered directly to an inside surface 48 of the transparent face shield 14. It is desirable that the formed sheet 10A in FIG. 6 have generally the same shape and characteristics of the formed sheet of laminated linear polarizer for the removable lens 10 shown in FIGS. 1–5. It is desirable, however, that the thickness of sheet 10A be thinner, e.g. 0.01 inch thickness, mostly so that the polarized lens 10A does not interfere with any of the mechanical mechanisms of the helmet 12. Optical quality adhesive should be used to adhere the entire surface of the polarized lens 10A to the inside surface of the transparent face shield 14 in order to eliminate the possibility of fogging or moisture accumulation between the polarized lens 10A and the inside surface of the transparent face shield 14. In other respects, the embodiment of the invention shown in FIG. 6 is similar to the embodiment of the invention shown in FIGS. 1–5.

Many helmet manufacturers use a double lens technology for the transparent face shield 14. In these systems, it may be desirable for an original equipment manufacturer to place the polarized lens 10 between the double lenses of the transparent face shield.

Figure 8:
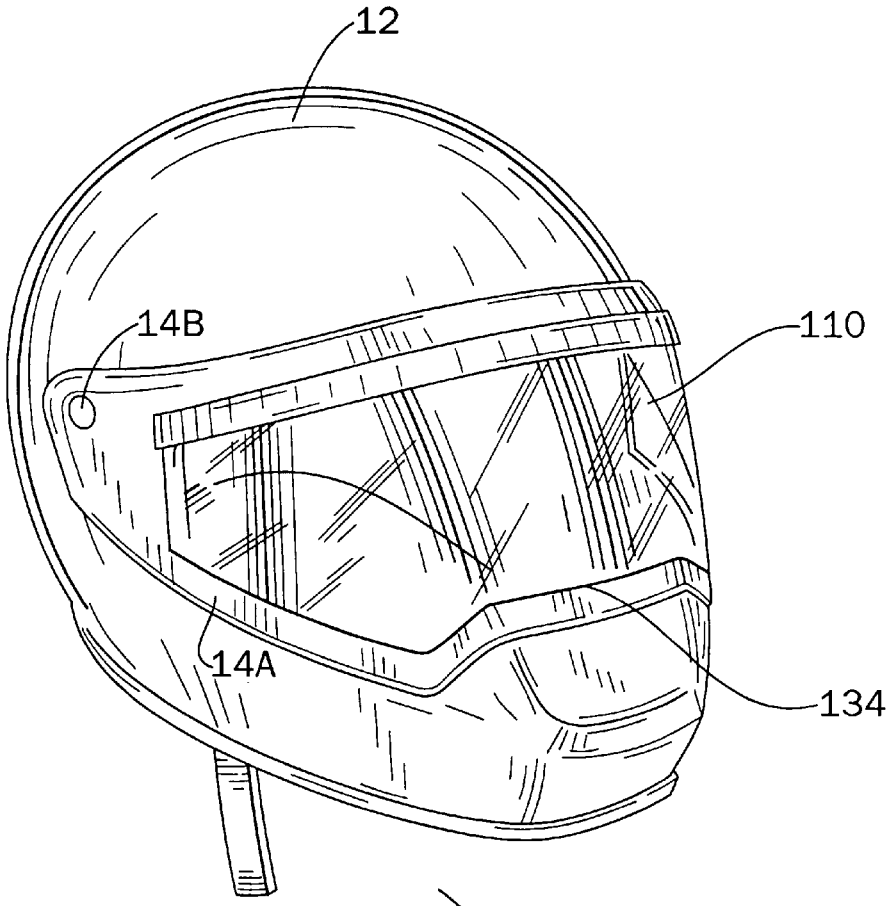
FIG. 8 is a perspective view of a snowmobile helmet having a transparent face shield with a polarized lens mounted to the helmet to cover the entire transparent face shield in accordance with another aspect of the invention.
Figure 9:
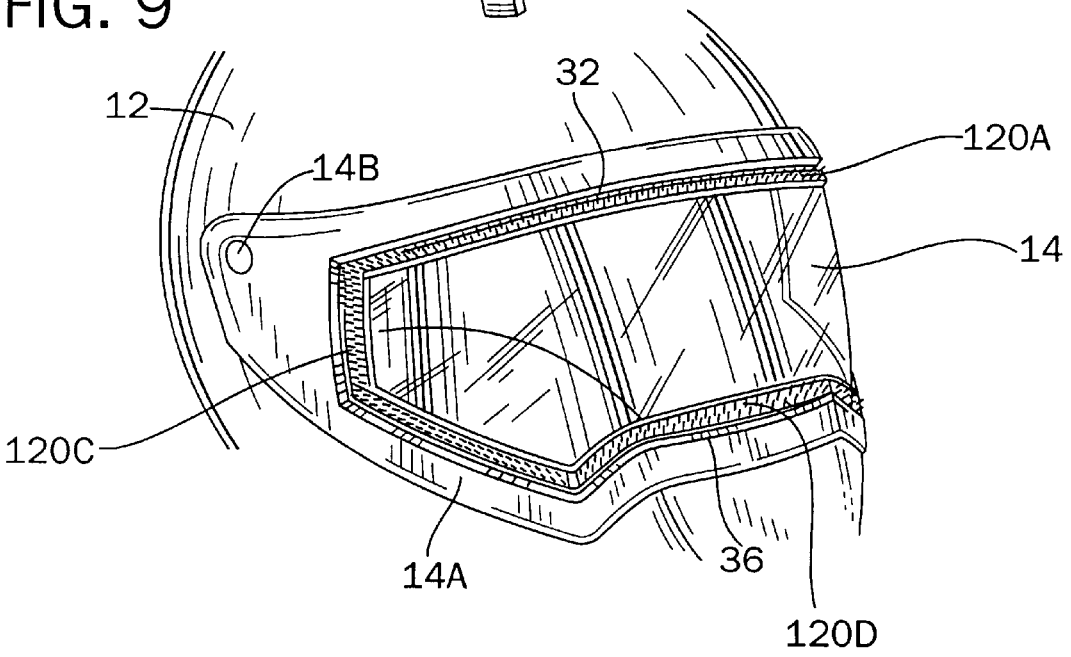
FIG. 9 is a view similar to FIG. 8 showing the full-face polarized lens removed from the transparent face shield of the helmet.

FIGS. 8 and 9 refer to another embodiment of the invention in which a full-face, polarized lens 110 covers the entire transparent face shield 14. The full-face polarized lens 110 shown in FIGS. 8 and 9 is removable, and is mounted to the helmet 12 using hook and loop fasteners. Preferably, hook and loop fastener is applied to an inside surface of the full-face polarized lens entirely along the peripheral edge of the lens 110. One or more mating strips 120A, 120C, and 120D of hook and loop fastener are adhered directly to the transparent face shield 14 also along the peripheral edge of the transparent face shield. In other respects, the full-face polarized lens 110 shown in FIG. 8 is similar to the polarized lens 10 shown in FIGS. 1–5. While the embodiment of the invention shown in FIGS. 8 and 9 does not allow the user of the lens 110 to quickly account for temporary relative darkness by cocking their head back slightly, the full-face polarized lens 110 shown in FIG. 8 may provide improved glare reduction for some users in some applications. The removable full-face polarized lens 110 shown in FIG. 8 is obviously more convenient to use than mechanically alternating between a tinted face shield and a clear face shield.

The invention has been described thus far primarily in connection with use on a snowmobile or motorcycle helmet, however, it should be recognized to those skilled in the art that the invention can be used on helmets used in other applications as long as the helmet has a transparent face shield. In addition, while the invention has been described in conjunction with exemplary embodiments, alternatives, modifications and equivalents to the invention may be apparent to those skilled in the art. The following claims should be interpreted to cover such alternatives, modifications and equivalents.

I claim:

1. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein the polarized lens is removably mounted to the helmet adjacent an outside surface of the transparent face shield; and a grip strip is provided along an outer surface of the polarized lens along a top edge of the polarized lens.

2. The apparatus for a helmet having a transparent face shield as recited in claim 1 wherein the grip strip is made of an ultraviolet protected vinyl adhesive tape and is adhered along an outer surface of the polarized lens along a top edge of the polarized lens.

3. The apparatus for a helmet having a transparent face shield as recited in claim 1 wherein the polarized lens is manufactured by forming the lens from a sheet of a laminated linear polarizer in which the polarization axis of the laminated linear polarizer is generally horizontal when the lens is attached to the helmet.

4. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly, the polarized lens is removably mounted directly to the transparent face shield of the helmet by using:

a first piece of strip fastener applied along at least a portion of a top edge of the polarized lens and a mating piece of fastener applied along a top edge of the transparent face shield;

a second piece of strip fastener applied along at least a portion of a right side edge of the polarized lens and a mating piece of strip fastener applied along a right side edge of the transparent face shield; and a third piece of strip fastener applied along at least a portion of a left side edge of the polarized lens and a mating piece of strip fastener applied along a left side edge of the transparent face shield; and the polarized lens extends outward beyond the strip fastener on either the left or the right side of the polarized lens to provide handle means for facilitating the attachment or removal of the removable polarized lens from the transparent face shield.

5. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein:

the polarized lens is removably mounted to the helmet adjacent an outside surface of the transparent face shield; and the polarized lens further comprises a snow dust guard extending perpendicularly from an inside surface of the polarized lens along a bottom edge of the polarized lens to provide a seal between the polarized lens and the transparent face shield.

6. An apparatus for a helmet having a transparent face shield, wherein the transparent face shield is capable of being located in front of a user's face when the user is wearing the helmet so that the user's field of vision passes through the transparent face shield and wherein the face shield also blocks wind and debris from the user's face, the apparatus comprising:

a polarized lens mounted to partially cover the transparent face shield, wherein a top portion of the transparent face shield is covered by the polarized lens to reduce glare in the user's field of vision when the user is holding their head comfortably in a normal upright position, and a lower portion of the transparent face shield is not covered by the polarized lens so that the user's primary field of vision is able to pass through the uncovered lower portion of the transparent face shield when the user's head is tilted back slightly; wherein the polarized lens is removably mounted directly to the transparent face shield of the helmet by using:

a first piece of strip fastener applied along at least a portion of a top edge of the polarized lens and a mating piece of fastener applied along a top edge of the transparent face shield;

a second piece of strip fastener applied along at least a portion of a right side edge of the polarized lens and a mating piece of strip fastener applied along a right side edge of the transparent face shield; and a third piece of strip fastener applied along at least a portion of a left side edge of the polarized lens and a mating piece of strip fastener applied along a left side edge of the transparent face shield; and wherein the strip fastener on the polarized lens is mounted onto the strip fastener on the transparent face shield so that the polarized lens covers the transparent face shield from a top edge of the transparent face shield downward to a bottom edge of the polarized lens which is located above a bottom edge for the transparent face shield when the polarized lens is mounted to the helmet, the polarized lens spans continuously between the right side edge of the transparent face shield and the left side edge of the transparent face shield; and the polarized lens is tilted with respect to the transparent face shield and a bottom edge of the polarized lens rests at least partially against the transparent face shield.

7. The apparatus for a helmet having a transparent face shield as recited in claim 6 wherein the polarized lens covers approximately ⅔ of the surface area of the transparent face shield.

8. The apparatus for a helmet having a transparent face shield as recited in claim 6 wherein the polarized lens has a bottom edge that is located at least 1 ⅝ inch above a bottom edge of the transparent face shield when the polarized lens is mounted to the helmet.

9. A kit comprising:

a polarized lens shaped to partially cover a transparent face shield on a helmet when the lens is mounted on the helmet, wherein a top portion of the transparent face shield is covered by the polarized lens to reduce glare in the user's field of vision when the user holds their head in a normal upright position, and a lower portion of the transparent face shield is not covered by the polarized lens to allow the user's field of vision to pass through the uncovered lower portion when the user's head is tilted slightly back;

a first piece of strip fastener adhered to an inside surface of the polarized lens along a top edge of the polarized lens and a mating piece of strip fastener having an adhesive-backed surface covered by a backing strip which is adapted to be adhered along a top edge of the transparent face shield of the helmet;

a second piece of strip fastener adhered along at least a portion of a right side edge of the polarized lens on the inside surface of the polarized lens;

a third piece of strip fastener adhered to at least a portion of a left side edge of the polarized lens on the inside surface of the polarized lens;

a mating piece of strip fastener for the second piece of strip fastener on the right side edge of the polarized lens; and a mating piece of strip fastener for the third piece of strip fastener on the left side edge of the polarized lens, the mating pieces for both the second and third pieces each having an adhesive-backed surface covered by a backing strip;

wherein the mating pieces are adhered to the transparent face shield for the helmet by the user and the polarized lens is then removably mounted thereto with the polarized lens tilted with respect to the transparent face shield so that a bottom edge of the polarized lens rests at least partially against the transparent face shield.

10. A kit as recited in claim 9 further comprising a grip strip adhered to an outside surface of the polarized lens along a top edge of the polarized lens, the grip strip being made of an ultraviolet protected vinyl adhesive strip.

11. A kit as recited in claim 9 further comprising a bag for storing the polarized lens, the bag having an inside surface and an outside surface each made of an absorbent, scratch-resistant material.

12. An apparatus for a helmet having a transparent face shield, wherein the transparent face shield is capable of being located in front of a user's face when the user is wearing the helmet so that the user's field of vision passes through the transparent face shield and the face shield also blocks wind and debris from the user's face, the apparatus comprising:

a polarized lens that is removably mounted to the helmet adjacent an outside surface of the transparent face shield using narrow strips of adhesive-backed hook and loop fastener, at least one strip of hook and loop fastener being adhered to an inside surface of the polarized lens exclusively along a peripheral edge of the polarized lens, at least one mating strip of hook and loop fastener adhered to the helmet to engage the at least one strip of hook and loop fastener on the inside surface of the polarized lens, the strips of hook and loop fastener being applied to the polarized lens and the helmet in a manner which removably secures the polarized lens to the helmet and does not significantly obstruct the user's normal field of vision through the transparent face shield wherein a grip strip of an ultraviolet protected vinyl adhesive tape is adhered alone an outer surface of the polarized lens along a top edge of the polarized lens.

13. The apparatus for a helmet having a transparent face shield as recited in claim 12 wherein the polarized lens extends outward beyond a removable strip of hook and loop fastener on either the left side or the right side of the linear polarizer in which the polarization axis is generally horizontal when the lens is adhered to the transparent face shield.

14. The apparatus for a helmet having a transparent face shield as recited in claim 12 wherein the polarized lens is manufactured by forming the lens from a sheet of laminated linear polarizer in which the polarization axis of the laminated linear polarizer is generally horizontal when the lens is attached to the helmet.

* * * * *

UNITED STATES PATENT AND TRADEMARK OFFICE

CERTIFICATE OF CORRECTION

PATENT NO. : 6,006,366
DATED : December 28, 1999
INVENTOR(S) : Paul C. Vondrak

It is certified that error appears in the above-identified patent and that said Letters Patent is hereby corrected as shown below:

Column 10,
Line 13, delete "at least one mating strip" and substitute therefor -- at least one strip --.
Lines 28-31, delete "linear polarizer in which the polarization axis is generally horizontal when the lens is adhered to the transparent face shield" and substitute therefor -- polarized lens to provide handle means for facilitating the attachment or removal of the removable polarized lens from the helmet --.

Signed and Sealed this

Sixteenth Day of July, 2002

*Attest:*

*Attesting Officer*

JAMES E. ROGAN
*Director of the United States Patent and Trademark Office*